US006520385B2

(12) United States Patent
Bonningue et al.

(10) Patent No.: US 6,520,385 B2
(45) Date of Patent: Feb. 18, 2003

(54) PUMP INCLUDING A SPRING-FORMING DIAPHRAGM, AND A RECEPTACLE FITTED THEREWITH

(75) Inventors: Philippe Bonningue, Paris (FR); Alain Behar, Suresnes (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/785,505

(22) Filed: Feb. 20, 2001

(65) Prior Publication Data

US 2001/0054623 A1 Dec. 27, 2001

(30) Foreign Application Priority Data

Feb. 23, 2000 (FR) ..... 00 02242

(51) Int. Cl.[7] ..... F04B 7/02; B67D 5/42
(52) U.S. Cl. ..... 222/336; 222/321.9
(58) Field of Search ..... 222/336, 321.1, 222/321.7, 321.9, 207

(56) References Cited

U.S. PATENT DOCUMENTS

| | | | | | |
|---|---|---|---|---|---|
| T993,004 | I4 | * | 4/1980 | French | 222/336 X |
| 4,452,379 | A | * | 6/1984 | Bundschuh | 222/321.7 X |
| 5,152,434 | A | * | 10/1992 | Birmelin | 222/207 |
| 5,267,673 | A | * | 12/1993 | Crosnier et al. | 222/321.7 |
| 5,518,377 | A | * | 5/1996 | Bougamont et al. | 222/321.9 X |
| 5,687,884 | A | | 11/1997 | Bodin et al. | 222/321.7 |
| 5,704,519 | A | * | 1/1998 | Crosnier et al. | 222/321.7 X |
| 5,788,124 | A | * | 8/1998 | Bougamont et al. | 222/321.9 X |
| 6,202,896 | B1 | * | 3/2001 | Bonningue | 222/321.1 |
| 6,227,414 | B1 | * | 5/2001 | Peronnet et al. | 222/321.7 X |

FOREIGN PATENT DOCUMENTS

| | | | |
|---|---|---|---|
| FR | 2 728 809 | | 1/1995 |
| FR | 2708314 | * | 2/1995 |
| FR | 2746076 | * | 9/1997 |

* cited by examiner

*Primary Examiner*—Kenneth Bomberg
(74) *Attorney, Agent, or Firm*—Oliff & Berridge, PLC

(57) ABSTRACT

A pump comprising a support-forming assembly for securing to a receptacle containing a substance to be dispensed, a moving member co-operating with the support-forming assembly to define a pump chamber of variable volume, and an elastically deformable diaphragm secured to one of the support-forming assembly and the moving member, the diaphragm being arranged so as to deform elastically when the moving member is displaced relative to the support, the pump further comprising a suction valve-forming element arranged to oppose any return of substance towards the receptacle while the volume of the pump chamber is decreasing, and a delivery valve-forming element arranged to oppose any entry of air into the receptacle while the volume of the pump chamber is increasing. The delivery valve-forming element is made by means of a shutter-forming element that is separate from the diaphragm.

53 Claims, 3 Drawing Sheets

PUMP INCLUDING A SPRING-FORMING DIAPHRAGM, AND A RECEPTACLE FITTED THEREWITH

BACKGROUND OF INVENTION

1. Field of Invention

The invention relates to a pump for dispensing a substance, in particular a cosmetic.

2. Description of the Related Art

French patent 2 728 809 discloses a pump comprising a pushbutton mounted to move relative to a support which is secured to a receptacle containing the substance to be dispensed, the pushbutton having a circularly cylindrical central duct provided with radial openings at its bottom end, the support defining an annular pump chamber of variable volume around said duct.

A diaphragm made of elastomer is mounted on the support.

The diaphragm has a circularly cylindrical central portion in the form of a sleeve that is open at its top end and closed at its bottom end.

The central duct of the pushbutton is inserted into the diaphragm until it bears against the bottom of the sleeve-shaped central portion.

The diaphragm constitutes a resilient return member enabling the pushbutton to be returned to its initial position after a quantity of substance has been dispensed.

In addition, during the return movement of the pushbutton, the diaphragm presses against the central duct, thereby isolating the pump chamber and making it possible to prevent air from penetrating into it.

The diaphragm thus acts as a delivery valve. The diaphragm also acts as a suction valve.

Such a pump has the advantage of comprising only a small number of parts and thus of being relatively inexpensive to manufacture.

Nevertheless, that pump does not give full satisfaction, the Applicant company having observed that the pushbutton tends to jam and/or to dispense poorly and in non-uniform quantities.

OBJECTS AND SUMMARY OF THE INVENTION

The present invention seeks to improve the operating reliability of a pump of the type defined above, i.e. comprising a support-forming assembly for securing to a receptacle containing a substance to be dispensed, a moving member co-operating with the support-forming assembly to define a pump chamber of variable volume, and an elastically deformable diaphragm secured to one of the support-forming assembly and the moving member, the diaphragm being arranged so as to deform elastically when the moving member is displaced relative to the support, the pump further comprising a suction valve-forming element arranged to oppose any return of substance towards the receptacle while the volume of the pump chamber is decreasing, and a delivery valve-forming element arranged to oppose any entry of air into the receptacle while the volume of the pump chamber is increasing.

In the pump of the invention, the delivery valve-forming element is made by means of a shutter-forming element that is separate from the diaphragm and the diaphragm is prestressed when the pump is at rest.

Thus, in the invention, the diaphragm can act as a spring without any fear of the moving member jamming; since the element forming the delivery valve is distinct from the diaphragm, there is no risk of the diaphragm impeding departure of the substance leaving the pump chamber.

Since the diaphragm is prestressed when the pump is at rest, any clearance at rest is avoided and any risk of substance leaking in the event of the pump being transported is reduced.

In the known pump described in French patent 2 729 809, the diaphragm is tensioned when the pushbutton is pushed in, and one consequence of this tension can be to impede the flow of the substance leaving the pump chamber and to make priming difficult.

In a particular embodiment, the diaphragm has a central portion in the form of a sleeve that is open at one end and closed at its opposite end, the moving member bearing against said central portion.

Still in a particular embodiment, the moving member, i.e. the pushbutton, for example, comprises first and second moving portions that are movable relative to each other, the first portion co-operating with the support-forming assembly to define the variable-volume pump chamber, the second portion being movable relative to the first portion between firstly a dispensing position in which it is suitable for entraining the first portion in the direction to decrease the volume of the pump chamber, and secondly in a position relating to suction in which it is suitable for entraining the first portion in the direction to increase the volume of the pump chamber, the shutter-forming element being secured to the second portion, the first portion having a passage to enable substance to flow towards a dispensing endpiece, the shutter-forming element being movable relative to the first portion between a position relating to closure in which it closes said passage, and a position relating to dispensing in which it ceases to close said passage.

Such a pump is relatively easy to manufacture since it has only a small number of parts that are easy to assemble together.

In a particular embodiment, the shutter-forming element is in its position relating to closure while the second portion of the moving member is in its position relating to suction, and the shutter-forming element is in its position relating to dispensing while the second portion of the moving member is in its position relating to dispensing.

Preferably, the shutter-forming element bears against the diaphragm.

When it has a central portion in the form of a sleeve, the shutter-forming element advantageously bears against the bottom of said central portion.

Still in the context of the diaphragm including a sleeve-shaped central portion, the above-mentioned passage is advantageously defined by a chimney engaged inside said central portion.

In which case, the shutter-forming element advantageously has a rod fixed at one end to the second portion of the moving member, said rod extending inside the chimney and being provided at its opposite end with a valve-forming portion suitable for bearing in leakproof manner against the chimney so as to close it.

In a particular embodiment, at least one of the first and second portions of the moving member includes a sealing lip suitable for bearing in leakproof manner against the other portion during relative displacement of these two portions.

Thus, the relative movement of the two portions of the moving member can take place without any fear of the substance leaking.

Preferably, the sealing lip is formed on the first portion at one end of the above-mentioned passage.

In a particular embodiment, the first portion is snap-fastened in the support-forming assembly.

Advantageously, this first portion corresponds to the bottom portion of a pushbutton comprising two telescopic portions.

In a particular embodiment, the support-forming assembly includes an insert on which the diaphragm is mounted.

Still in a particular embodiment, the diaphragm has a peripheral portion defining a groove enabling it to be mounted on the insert.

In a particular embodiment, the insert has a suction valve integrally formed by molding a plastic material.

In a variant, the peripheral portion of the diaphragm includes a flexible lip forming a suction valve, the support-forming assembly having one or more openings enabling substance to reach the pump chamber while its volume is increasing, said opening(s) being closed by the flexible lip while the volume of the pump chamber is decreasing.

The invention also provides a receptacle fitted with a pump as defined above.

BRIEF DESCRIPTION OF THE DRAWINGS

Other characteristics and advantages of the present invention will appear on reading the following detailed description of non-limiting embodiments of the invention, and on examining the accompanying drawings, in which.

DETAILED DESCRIPTION OF EXEMPLARY EMBODIMENTS

Figure 1:
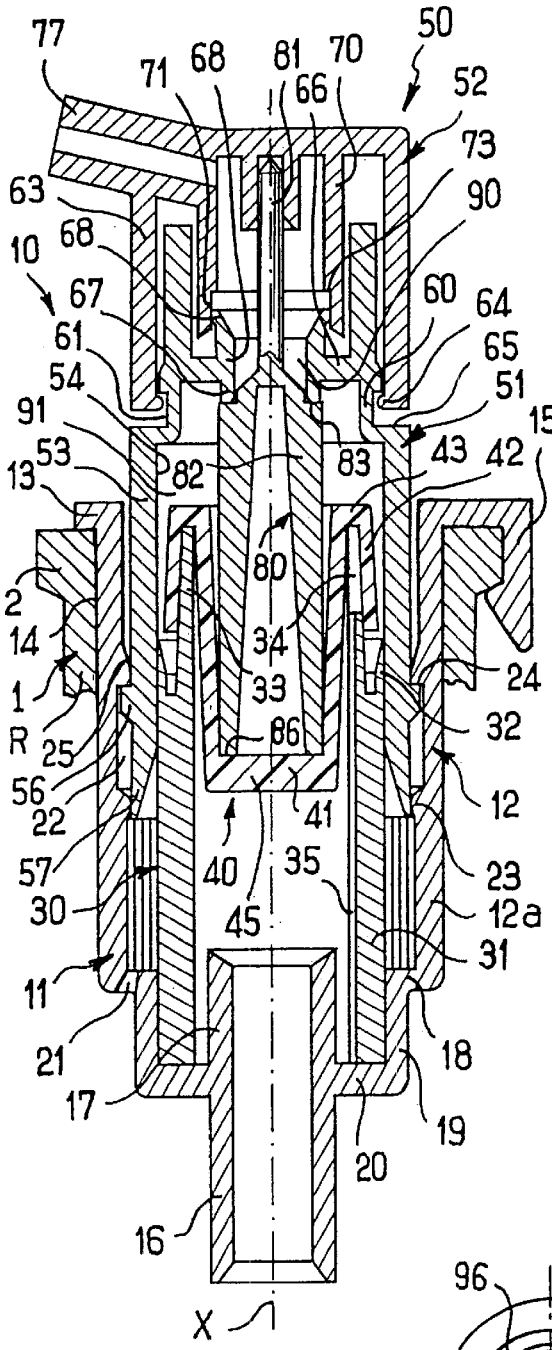
FIG. 1 is a diagrammatic axial section view of a pump constituting an embodiment of the invention.
Figure 2:
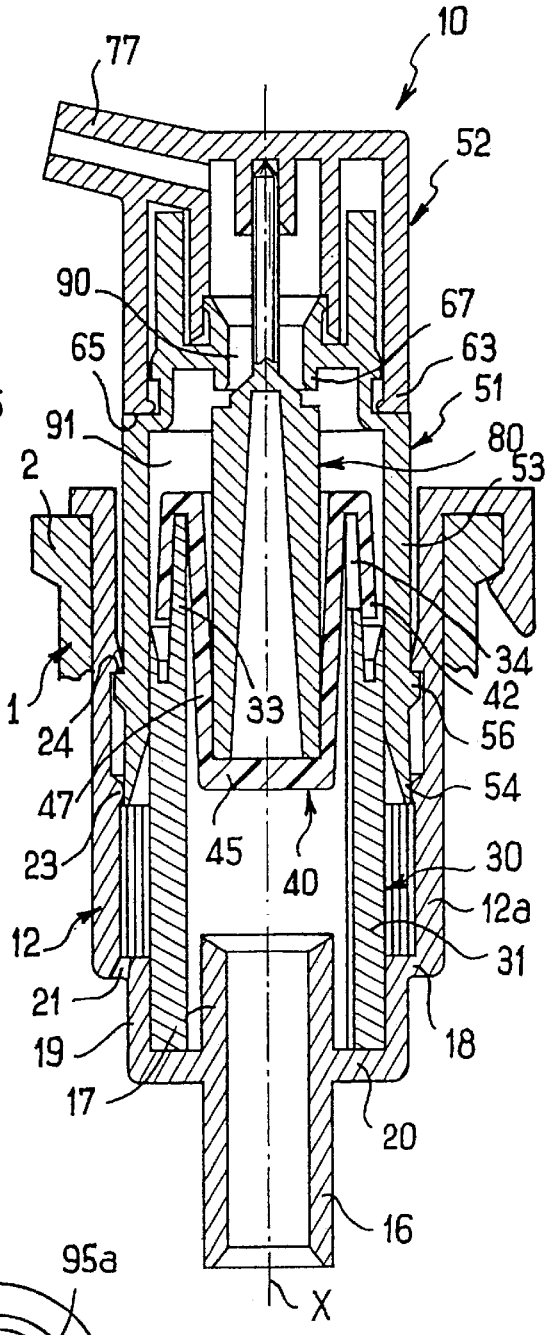
FIG. 2 shows the FIG. 1 pump after the pushbutton has been pushed down a little.

FIGS. 1 and 2 show a pump 10 for mounting on a receptacle R which is represented in the figures solely by the top end of its neck 1 which is provided with an annular lip 2.

The pump 10 comprises a static assembly 11 made up of a support 12 and an insert 30.

The support 12 has a tubular skirt 12*a* about an axis X, provided at its top end with a rim 13, the rim being directed regularly outwards. The tubular skirt 12*a* bears in leakproof manner via its radially outer surface 14 against the radially inner surface of the neck 1 of the receptacle R.

The rim 13 is extended radially outwards at several points around its periphery by assembly tabs 15 which are arranged to snap-fasten to the annular lip 2.

The bottom end of the tubular skirt 12*a* is connected via a transverse wall 20 to an endpiece 16 for connection to a dip tube (not shown) so as to enable the receptacle R to be used in the head-up position.

Inside the support 12, the endpiece 16 is extended upwards by a duct 17.

In its bottom portion, the tubular skirt 12*a* has an inwardly directed step 18 which is connected to a cylindrical wall 19 about the axis X for mounting the insert 30.

At its bottom, the cylindrical wall 19 is connected to the above-mentioned transverse wall 20.

At the step 18, the support 12 has a through orifice 21 for allowing air to penetrate into the receptacle R, as described below.

Furthermore, substantially halfway up the tubular skirt 12*a*, there is an annular groove 22 formed in its radially inner surface.

The bottom of this groove 22 is defined by an annular bead 23 and the top by a shoulder 24 which is situated at the bottom end of a ramp 25 sloping inwards and downwards.

The insert 30 has a tubular wall 31 about the axis X which is engaged by force at its bottom end into the cylindrical wall 19.

The tubular wall 31 splits into two at its top end so as to form firstly a radially outer sealing lip 32 and secondly a radially inner extension 33 having a plurality of openings 34 passing through it and spaced around its periphery for a purpose that is explained below.

Longitudinal channels 35 are formed in the radially inner surface of the tubular wall 31 extending as far as the openings 34.

The extension 33 serves to secure a diaphragm 40 made of elastomer material, e.g. a nitrile or a silicone elastomer.

The diaphragm 40 has a central portion in the form of a sleeve 41 and a flexible annular lip 42 at its top, said annular lip 42 surrounding the sleeve-forming central portion 41 and being connected to the top end thereof by means of a transverse wall 43 that bears against the top end edge of the above-mentioned extension 33.

The central portion of the diaphragm 40 is closed by a bottom wall 45.

The height of the annular lip 42 is greater than that of the openings 34 and the annular lip 42 is arranged, at rest, to bear in leakproof manner against the radially outer surface of the extension 33 so as to be capable of preventing substance returning towards the receptacle R via the openings 34, as explained below.

In addition to the static assembly 11 as described above, the pump 10 also includes a moving assembly forming a pushbutton 50, the moving assembly comprising a bottom portion 51 which is engaged in part in the support 12, and a top portion 52 that is movable relative to the bottom portion 51.

The bottom portion 51 has an assembly skirt 53 arranged to snap-fasten in the support 12.

This assembly skirt 53 has a radially inner surface 54 that is circularly cylindrical about the axis X and that has the annular sealing lip 32 of the insert 30 bearing thereagainst in leakproof manner.

The assembly skirt 53 also has teeth 56 on its radially outer surface arranged to snap-fasten in the annular groove 22 of the support 12.

The bottom end 57 of the assembly skirt 53 comprises an annular lip that is arranged to bear in leakproof manner against the annular bead 23 when the teeth 56 are resting against the shoulder 24, as shown in FIG. 1.

This prevents air entering into the receptacle when the pump is at rest.

Above the assembly skirt 53, the bottom portion 51 has a neck 60.

In its radially outer surface, the neck 60 has an annular groove 61 for securing the top portion 52 of the pushbutton.

The top portion 52 has an assembly skirt 63 provided at its bottom end with an annular bead 64 that is arranged to snap into the above-mentioned groove 61.

Together with the assembly skirt 53, the neck 60 forms a shoulder 65 against which the top portion 52 can bear.

The bottom portion 51 has a transverse wall 66 which connects to the bottom surface of the neck 60 above the annular groove 61.

This transverse wall 66 supports an annular lip 67 that extends downwards and an annular lip 68 that extends upwards, for functions that are described below.

The top portion 52 has an inner skirt 70 whose radially inner surface presents a shoulder 73 at its bottom end, said shoulder 73 axially defining a circularly cylindrical surface 71 against which the top end of the annular lip 68 bears in leakproof manner.

A cylindrical housing 74 is formed in the center of the inner skirt 70 for receiving a shutter-forming element 80 which is described below.

The top portion 52 has a dispenser endpiece 77 communicating with the space defined by the inner skirt 70.

The annular lips 67 and 68 define a passage 90 that enables substance coming from the receptacle to reach the dispenser endpiece 77.

At its top portion, the shutter-forming element 80 has a rod 81 which is received in the housing 74, and in its bottom portion it has an internally hollowed-out portion 82 that is connected to the rod 81 by forming a shoulder 83.

This shoulder 83 is arranged to bear against the bottom end of the annular lip 67 when the pump is at rest, as shown in FIG. 1. The shutter-forming element 80 then has its bottom end 86 resting against the bottom wall 45 of the central portion 41 of the diaphragm 40;

When the shutter-forming element 80 bears against the annular lip 67 and the bottom portion 51 of the pushbutton bears via its teeth 56 against the shoulder 24, the tubular wall of the diaphragm 40 extending between the end wall 45 and the transverse wall 43 is under tension.

Together with the diaphragm 40 and the shutter-forming element 80, the bottom portion 51 defines a pump chamber 91 of variable volume.

The operation of the pump 10 is described below.

It is assumed that the pump 10 is primed.

When the pump 10 is at rest, the passage 90 is closed by the shutter-forming element 80 and the bottom portion 51 bears via its teeth 56 against the shoulder 24 under the return action of the diaphragm 40.

When the user presses down the top portion 52, it begins by coming to bear via the bottom end of its assembly skirt 63 against the shoulder 65 of the bottom portion 51, so the shutter-forming element 80 releases the passage 90.

Thereafter, the top portion 52 entrains the bottom portion 51 downwards.

The downward displacement of the bottom portion 51 reduces the volume of the pump chamber 91 and causes the substance to be delivered via the dispensing endpiece 77.

The pressure in the substance has the effect of pressing the flexible lip 42 against the radially outer surface of the extension 33 as the volume of the pump chamber decreases, thereby preventing any substance returning towards the receptacle R.

The downward stroke of the bottom portion 51 continues until its teeth 56 come to bear against the annular bead 23, thus causing the sealing lip 57 to cease to bear in leakproof manner against the annular bead 23 and allowing air to be taken into the receptacle R via the air intake orifice 21, the air flowing between the assembly skirt 53 and the support 12.

During the downward movement of the pushbutton 50, the shutter-forming element 80 bears against the bottom wall 45 of the diaphragm 40 and gives rise to elastic deformation of the central portion 41 of the diaphragm.

The diaphragm 40 thus behaves like a spring and confers behavior on the pump 10 that is agreeable to the user.

When the user releases the pushbutton 50, the shutter-forming element 80 is returned by the diaphragm 40 to come into abutment against the annular lip 67, thereby closing the passage 90, and then the bottom portion 51 is returned upwards, having the consequence of increasing the volume of the pump chamber 91 and of causing substance to be sucked into it, with the flexible lip 42 moving away from the insert 30 so as to allow the substance to flow through the openings 34.

Figure 4:
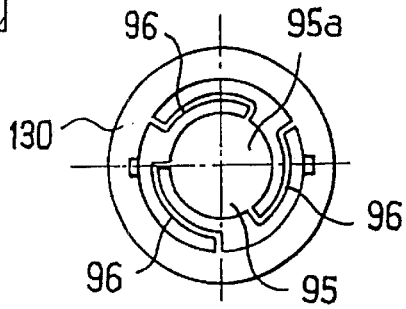
FIG. 4 is a fragmentary cross-section view on line IV—IV of FIG. 3.
Figure 3:
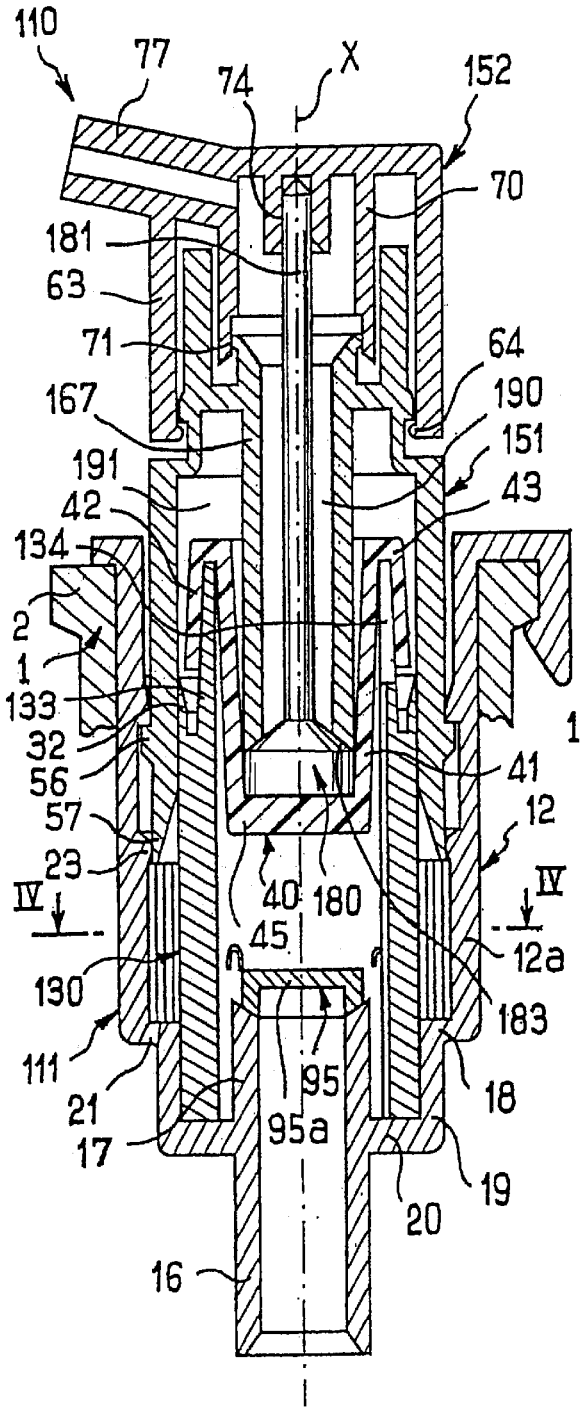
FIG. 3 is a diagrammatic axial section view through a pump constituting a second embodiment of the invention.
Figure 5:
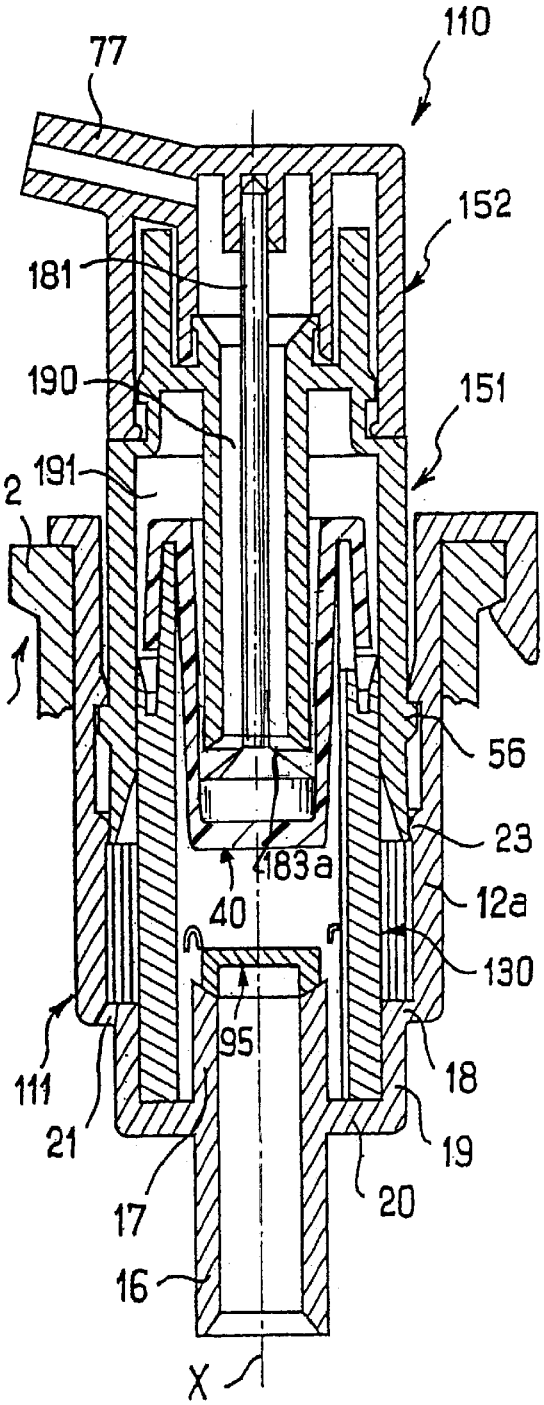
FIG. 5 is a view analogous to FIG. 3 after the pushbutton has been pushed down a little.

FIGS. 3 to 5 show a pump constituting a first variant of the invention.

The same reference numerals are conserved in these figures to designate elements that are identical to those described above.

The pump 110 shown in FIGS. 3 to 5 differs from the pump 10 described above essentially in the shape of its shutter-forming element, in the shape of the bottom portion of its pushbutton, and by the presence of a suction valve that is independent of the diaphragm.

In this example, the static assembly 11 of the pump 10 is replaced by a static assembly 111 having an insert 130 which differs from the above-described insert 30 by the presence of a valve 95 that is integrally molded out of the same plastics material as the insert 103.

The valve member 95*a* of the valve 95 is connected to the insert 130 by flexible links 96 which leave it free to move a little along the axis X.

At rest, the valve member 95*a* bears against the top end of the duct 17, as shown in FIGS. 3 and 5, thereby closing it.

When substance is sucked into the pump chamber, the valve body 95*a* lifts off the top end of the duct 17 so as to allow substance to pass through, with the links 96 deforming elastically.

In the embodiment of FIGS. 3 to 5, the bottom portion 51 of the pushbutton 50 in the preceding embodiment is replaced by a bottom portion 151 which differs by the fact that the bottom annular lip 67 is replaced by a chimney 167 which extends inside the central portion of the diaphragm 40 and defines a passage 190 for the substance.

The top portion 152 has a shutter-forming element 180 which includes a rod 181 fixed at one end in the housing 74. This rod 181 is provided at its other end with a valve-forming element 183 having an upwardly converging frustoconical surface 183*a*.

The bottom end of the chimney 167 is shaped to bear in leakproof manner against said frustoconical surface 183*a* when the pump 110 is at rest, i.e. in the configuration shown in FIG. 3.

The valve-forming portion 183 rests permanently against the bottom wall 45 of the diaphragm 40.

The insert 130 differs from the above-described insert 30 by the fact that the extension 33 is replaced by an extension 133 provided with openings 134 which extend over a height that is greater than that of the flexible lip 42 of the diaphragm 40;

Thus, in the embodiments of FIG. 3 to 5, the flexible lip 42 serves solely for connection purposes and it no longer performs the additional function of a suction valve, as is the case in the embodiment of FIGS. 1 and 2.

The pump 110 operates as follows.

It is assumed that the pump chamber 191 as defined by the insert 130, the bottom portion 151, and the chimney 167, is full of substance.

When the user presses on the top portion 152, that causes the shutter-forming element 180 to move downwards relative to the bottom portion 151 so the valve-forming portion 183 moves away from the bottom end of the chimney 167.

The bottom end of the assembly skirt 63 comes to bear against the bottom portion 151 at the end of a predetermined stroke.

With continued downward movement of the pushbutton, the volume of the pump chamber 191 decreases and the substance is expelled towards the passage 190 formed inside the chimney 167.

Since the member 95*a* of the valve 95 is pressed against its seat constituted by the top end of the duct 17, it prevents substance from returning towards the receptacle.

While the pushbutton is being pushed down, the central portion of the diaphragm deforms elastically, thereby acting as a spring.

When the user releases the top portion 152, the diaphragm 40 begins by returning the shutter-forming element 180 so that it bears against the bottom end of the chimney 167 in order to close the passage 190.

The top portion 152 is then entrained upwards by the diaphragm 40 which tends to return to its initial shape.

The volume of the pump chamber 191 increases and substance is sucked in from the receptacle R.

The substance flows via the duct 17, with the member 95*a* of the valve 95 lifting off the top end of the duct 17.

Figure 6:
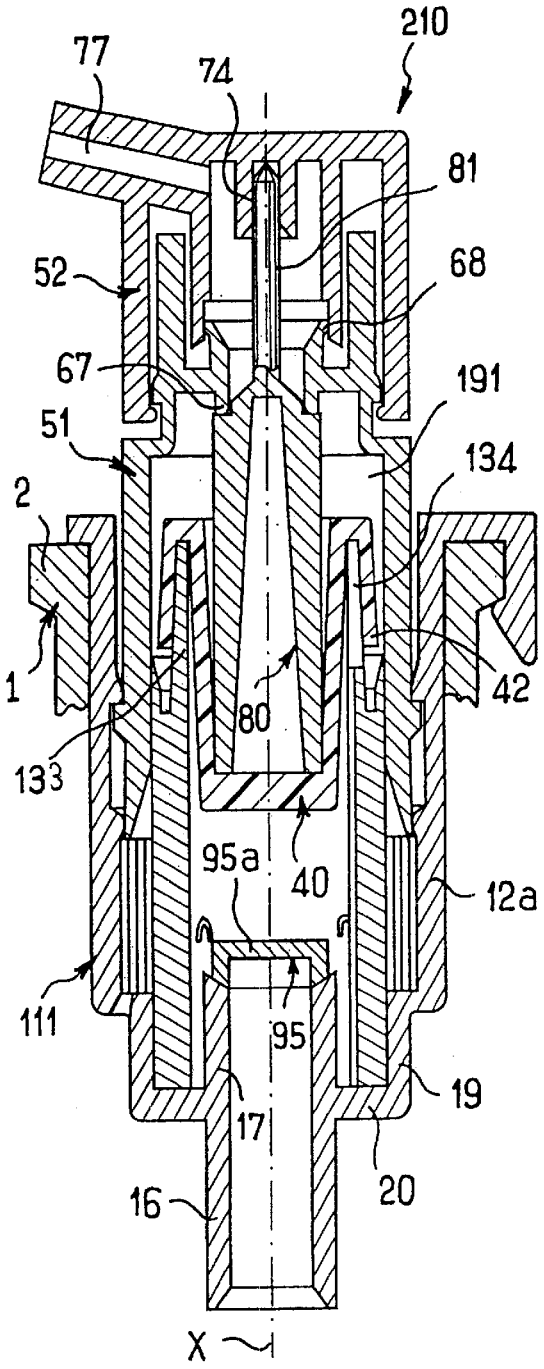
FIG. 6 is a diagrammatic axial section view of a pump constituting a third embodiment of the invention.
Figure 7:
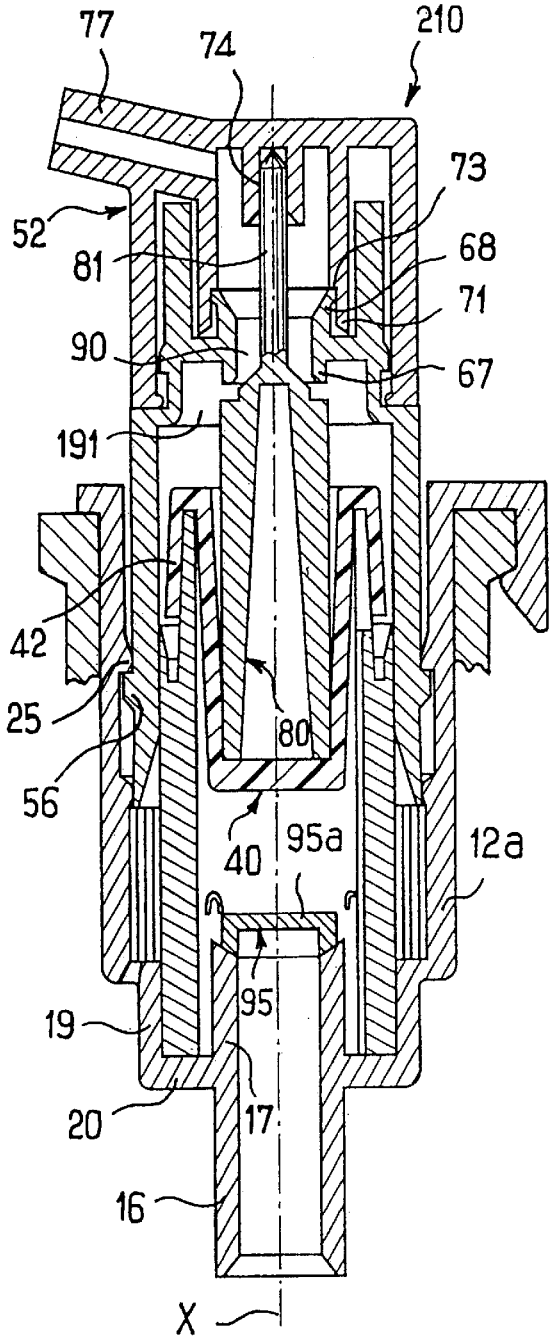
FIG. 7 is a view analogous to FIG. 6 after the pushbutton has been pushed down a little.

FIGS. 6 and 7 show a variant embodiment which differs from that of FIGS. 3 and 5 by the fact that the shutter-forming element 180 is replaced by the shutter-forming element 80 as described with reference to FIGS. 1 and 2.

The bottom portion 151 of the pushbutton in the preceding embodiment is replaced by the previously described bottom portion 51.

Naturally, the invention is not limited to the embodiments described above.

In particular, the suction valve and the delivery valve can be implemented in numerous other ways.

For example, the suction valve can be implemented in the form of a ball.

What is claimed is:

1. A pump comprising:

a support;

a moving member co-operating with the support to define a pump chamber of variable volume;

an elastically deformable diaphragm being arranged so as to deform elastically when the moving member is displaced relative to the support, said diaphragm being prestressed when the pump is at rest;

a suction valve arranged to oppose any return of substance towards a receptacle containing a substance to be dispensed, while the volume of the pump chamber is decreasing; and a delivery valve arranged to oppose any entry of air into the pump chamber while the volume of the pump chamber is increasing, said delivery valve comprising a shutter-forming element being separate from the diaphragm.

2. A pump according to claim 1, wherein the support comprises an insert on which the diaphragm is mounted.

3. A pump according to claim 2, wherein the diaphragm has a peripheral portion defining a groove enabling it to be mounted on the insert.

4. A pump according to claim 3, wherein the peripheral portion of the diaphragm includes a flexible lip forming a suction valve, the support having one or more openings enabling substance to reach the pump chamber while its volume is increasing, said opening(s) being closed by the flexible lip while the volume of the pump chamber is decreasing.

5. A pump according to claim 2, wherein the insert has a suction valve integrally formed therewith by molding a plastic material.

6. A receptacle fitted with a pump as defined in claim 1.

7. A pump according to claim 1, wherein said diaphragm is secured to one of the support and the moving member.

8. A pump comprising:

a support;

a moving member co-operating with the support to define a pump chamber of variable volume;

an elastically deformable diaphragm being arranged so as to deform elastically when the moving member is displaced relative to the support, said diaphragm being prestressed when the pump is at rest;

a suction valve arranged to oppose any return of substance towards a receptacle containing a substance to be dispensed, while the volume of the pump chamber is decreasing; and a delivery valve arranged to oppose any entry of air into the pump chamber while the volume of the pump chamber is increasing, said delivery valve comprising a shutter-forming element being separate from the diaphragm, wherein the moving member has first and second portions that are movable relative to each other, said first portion co-operating with the support to define the pump chamber aid second portion being movable relative to the first portion between:

firstly a dispensing position in which it is suitable for entraining the first portion in the direction to decrease the volume of the pump chamber, and secondly a position relating to suction in which it is suitable for entraining the first portion in the direction to increase the volume of the pump chamber, wherein the first portion has a passage to enable substance to flow towards a dispensing endpiece, and wherein the shutter-forming element is secured to the second portion and is movable relative to the first portion between a position relating to closure in which it closes said passage, and a position relating to dispensing which it ceases to close said passage.

9. A pump according to claim 8, wherein at least one of the first and second portions of the moving member includes a sealing lip suitable for bearing in a leakproof manner against the other portion during relative displacement of these two portions.

10. A pump according to claim 9, wherein the sealing lip is formed on the first portion at one end of said substance outlet passage.

11. A pump according to claim 8, wherein the first portion is snap-fastened in the support.

12. A pump according to claim 8, wherein the shutter-forming element is in its position relating to closure while the second portion of the moving member is in its position relating to suction, and wherein the shutter-forming element is in its position relating to dispensing while the second portion of the moving member is in its position relating to dispensing.

13. A pump according to claim 8, wherein the shutter-forming element bears against the diaphragm.

14. A pump according to claim 13, the diaphragm having a central portion in the form of a sleeve, said central portion comprising a bottom wall, wherein the shutter-forming element bears against said bottom wall.

15. A pump according to claim 8, the diaphragm having a central portion in the form of a sleeve, wherein said first portion comprises a chimney engaged inside said central portion and comprising a passage for substance outlet.

16. A pump according to claim 15, wherein the shutter-forming element has a rod fixed at a first end to the second portion of the moving member, said rod extending inside the chimney and-being provided at a second end opposite to said first end with a valve-forming portion suitable for bearing in leakproof manner against the chimney so as to close it.

17. A pump according to claim 8, wherein said diaphragm is secured to one of the support and the moving member.

18. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed, while the volume of the pump chamber is decreasing; and a delivery valve arranged to oppose any entry of air into the pump chamber while the volume of the pump chamber is increasing, said delivery valve comprising a shutter-forming element being separate from the diaphragm, wherein the diaphragm has a central portion in the form of a sleeve being open at a first end and closed at a second end opposite to said first end, the moving member bearing against said central portion.

19. A pump according to claim 18, wherein said diaphragm is prestressed when the pump is at rest.

20. A pump according to claim 18, wherein said diaphragm is secured to one of the support and the moving member.

21. A pump according to claim 18, wherein the support comprises an insert on which the diaphragm is mounted.

22. A pump according to claim 21, wherein the diaphragm has a peripheral portion defining a groove enabling it to be mounted on the insert.

23. A pump according to claim 22, wherein the peripheral portion of the diaphragm includes a flexible lip forming a suction valve, the support having one or more openings enabling substance to reach the pump chamber while its volume is increasing, said openings being closed by the flexible lip while the volume of the pump chamber is decreasing.

24. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed while the volume of the pump chamber is decreasing; and a delivery valve arranged to oppose any entry of air into the pump chamber while the volume of the pump chamber is increasing, said delivery valve comprising a shutter-forming element being separate from the diaphragm, wherein the moving member has first and second portions that are movable relative to each other, said first portion co-operating with the support to define the pump chamber, said second portion being movable relative to the first portion between:

firstly a dispensing position in which it is suitable for entraining the first portion in the direction to decrease the volume of the pump chamber, and secondly a position relating to suction in which it is suitable for entraining the first portion in the direction to increase the volume of the pump chamber, wherein the first portion has a passage to enable substance to flow towards a dispensing endpiece, and wherein the shutter-forming element is secured to the second portion and is movable relative to the first portion between a position relating to closure in which it closes said passage, and a position relating to dispensing in which it ceases to close said passage.

25. A pump according to claim 24, wherein the shutter-forming element is in its position relating to closure while the second portion of the moving member is in its position relating to suction, and wherein the shutter-forming element is in its position relating to dispensing while the second portion of the moving member is in its position relating to dispensing.

26. A pump according to claim 24, wherein the shutter-forming element bears against the diaphragm.

27. A pump according to claim 26, the diaphragm having a central portion in the form of a sleeve, said central portion comprising a bottom wall, wherein the shutter-forming element bears against said bottom wall.

28. A pump according to claim 24, the diaphragm having a central portion in the form of a sleeve, wherein said first portion comprises a chimney engaged inside said central portion and comprising a passage for substance outlet.

29. A pump according to claim 28, wherein the shutter-forming element has a rod fixed at a first end to the second portion of the moving member, said rod extending inside the chimney and being provided at a second end opposite to said first end with a valve-forming portion suitable for bearing in leakproof manner against the chimney so as to close it.

30. A pump according to claim 24, wherein at least one of the first and second portions of the moving member includes a sealing lip suitable for bearing in a leakproof manner against the other portion during relative displacement of these two portions.

31. A pump according to claim 30, wherein the sealing lip is formed on the first portion at one end of said substance outlet passage.

32. A pump according to claim 24, wherein the first portion is snap-fastened in the support.

33. A pump according to claim 24, wherein said diaphragm is secured to one of the support and the moving member.

34. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed while the volume of the pump chamber is decreasing; and a delivery valve arranged to oppose any entry of air into the pump chamber while the volume of the pump chamber is increasing, said delivery valve having a shutter-forming element, wherein the moving member has first and second portions that are movable relative to each other, said first portion co-operating with the support to define the pump chamber, said second portion being movable relative to the first portion between:

firstly a dispensing position in which it is suitable for entraining the first portion in the direction to decrease the volume of the pump chamber, and secondly a position relating to suction in which it is suitable for entraining the first portion in the direction to increase the volume of the pump chamber, wherein the first portion has a passage to enable substance to flow towards a dispensing endpiece, and wherein the shutter-forming element is secured to the second portion and is movable relative to the first portion between a position relating to closure in which it closes said passage, and a position relating to dispensing in which it ceases to close said passage.

35. A pump according to claim 34, wherein said diaphragm is secured to one of the support and the moving member.

36. A pump according to claim 34, wherein said diaphragm is prestressed when the pump is at rest.

37. A pump according to claim 34, wherein the shutter-forming element is in its position relating to closure while the second portion of the moving member is in its position relating to suction, and wherein the shutter-forming element is in its position relating to dispensing while the second portion of the moving member is in its position relating to dispensing.

38. A pump according to claim 34, wherein the shutter-forming element bears against the diaphragm.

39. A pump according to claim 34, the diaphragm having a central portion in the form of a sleeve, wherein said first portion comprises a chimney engaged inside said central portion and comprising a passage for substance outlet.

40. A pump according to claim 34, wherein at least one of the first and second portions of the moving member includes a sealing lip suitable for bearing in a leakproof manner against the other portion during relative displacement of these two portions.

41. A pump according to claim 34, wherein the first portion is snap-fastened in the support.

42. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed while the volume of the pump chamber is decreasing; and a delivery valve arranged to oppose any entry of air into the pump chamber while the volume of the pump chamber is increasing, said delivery valve comprising a shutter-forming element being separate from the diaphragm, wherein said diaphragm is suitable for exerting an elastic effort on said shutter-forming element.

43. A pump according to claim 42, wherein said diaphragm is secured to one of the support and the moving member.

44. A pump according to claim 42, wherein the shutter-forming element bears against the diaphragm.

45. A pump according to claim 42, the diaphragm having a central portion in the form of a sleeve, said central portion comprising a bottom wall, wherein the shutter-forming element bears against said bottom wall.

46. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed while the volume of the pump chamber is decreasing; and a delivery valve arranged to oppose any entry of air into the pump chamber while the volume of the pump chamber is increasing, said delivery valve comprising a shutter-forming element being separate from the diaphragm, wherein said shutter-forming element can not be reached directly from the outside of the pump and has a constant shape between an open position and a closed position.

47. A pump according to claim 46, wherein said diaphragm is secured to one of the support and the moving member.

48. A pump according to claim 46, wherein the shutter-forming element bears against the diaphragm.

49. A pump according to claim 48, the diaphragm having a central portion in the form of a sleeve, said central portion comprising a bottom wall, wherein the shutter-forming element bears against said bottom wall.

50. A pump comprising:

a support;

a moving member co-operating with the support to define a pump chamber of variable volume;

an elastically deformable diaphragm being arranged so as to deform elastically when the moving member is displaced relative to the support;

a suction valve arranged to oppose any return of substance towards a receptacle containing a substance to be dispensed while the volume of the pump chamber is decreasing; and a delivery valve arranged to oppose any entry of air into the pump chamber while the volume of the pump chamber is increasing, said delivery valve comprising a shutter-forming element being separate from the diaphragm, said shutter-forming element having a con stant shape between an open position and a closed position, wherein said diaphragm has an axis and said shutter-forming element has an axis being parallel to the axis of said diaphragm.

51. A pump according to claim 50, wherein said diaphragm is secured to one of the support and the moving member.

52. A pump according to claim 50, wherein the shutter-forming element bears against the diaphragm.

53. A pump according to claim 52, the diaphragm having a central portion in the form of a sleeve, said central portion comprising a bottom wall, wherein the shutter-forming element bears against said bottom wall.

* * * * *